US007825823B2

(12) United States Patent
Kuo

(10) Patent No.: US 7,825,823 B2
(45) Date of Patent: Nov. 2, 2010

(54) MULTI-CHANNEL SIGNAL MONITORING CIRCUIT

(75) Inventor: Heng-Chen Kuo, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 984 days.

(21) Appl. No.: 11/615,020

(22) Filed: Dec. 22, 2006

(65) Prior Publication Data

US 2008/0117078 A1 May 22, 2008

(30) Foreign Application Priority Data

Nov. 17, 2006 (CN) ..... 2006 1 0156903

(51) Int. Cl.
*G08C 19/20* (2006.01)

(52) U.S. Cl. ..... 340/870.19; 340/870.21; 340/870.16; 341/141; 702/188; 702/189

(58) Field of Classification Search ..... 340/870.16, 340/870.19, 870.21; 341/141; 702/188, 702/189

See application file for complete search history.

(56) References Cited

U.S. PATENT DOCUMENTS 5,014,238 A * 5/1991 McLeish et al. ..... 702/189
5,774,733 A * 6/1998 Nolan et al. ..... 713/300
6,035,353 A 3/2000 Doi et al.
6,415,205 B1 * 7/2002 Myron et al. ..... 700/275
6,744,376 B1 * 6/2004 Pascalidis ..... 340/870.21
6,839,660 B2 * 1/2005 Eryurek et al. ..... 702/188
7,142,990 B2 * 11/2006 Bouse et al. ..... 702/35
7,453,380 B2 * 11/2008 Jung et al. ..... 341/141
2005/0187642 A1 8/2005 Kuo
2006/0224350 A1 * 10/2006 Tanizawa ..... 702/130
2007/0179756 A1 * 8/2007 Honda ..... 702/190

* cited by examiner

*Primary Examiner*—Timothy Edwards, Jr.
(74) *Attorney, Agent, or Firm*—Wei Te Chung

(57) ABSTRACT

A signal monitoring circuit includes a plurality of sensors, a meter chip, a micro control unit (MCU), and a multiplexer. The sensors are adapted for collecting electrical signals of an electrical system, and each of the sensors correspondingly generates an output signal. The multiplexer is adapted for receiving the output signal of each of the sensors. The MCU controls the multiplexer to selectively output one of the output signals. The meter chip receives the selected one of output signals from the multiplexer and generates corresponding meter signals to the MCU.

14 Claims, 2 Drawing Sheets

MULTI-CHANNEL SIGNAL MONITORING CIRCUIT

BACKGROUND OF THE INVENTION

1. Field of the Invention

The present invention relates to signal monitoring circuits used for checking and controlling apparatuses such as electronic devices, and particularly to a signal monitoring circuit that can monitor a plurality of signals by only employing a meter chip.

2. Description of Related Art

Generally, an electrical system can be wired so that various monitoring signals, such as voltage signals or current signals, are generated. The monitoring signals correspond to measurements of various critical functions of the electrical system, which are determined according to practical requirements.

Referring to FIG. 2, a conventional multi-channel signal monitoring circuit of an electrical system is shown. The signal monitoring circuit includes four sensors 50, four meter chips 60, and a micro control unit (MCU) 70. The sensors 50 are adapted for collecting four monitoring signals of the electrical system, and each sensor 50 generates a pair of corresponding differential signals. Each meter chip 60 is electrically connected to an output of a corresponding one of the sensors 50, and receives the differential signals generated by the corresponding one of the sensors 50. The meter chips 60 are electrically coupled to the MCU 70, and generate corresponding meter signals to the MCU 70, then the MCU 70 processes the meter signals using a preset program.

The above-mentioned signal monitoring circuit is capable of monitoring a plurality of signals by employing the plurality of meter chips 60. Each of the meter chips 60 connects one of the sensors 50 with the MCU 70. That is, the MCU can only process a signal generated from a sensor via a respective meter chip. As a result, the more sensors there are, the more meter chips are needed for transmitting the signals generated from the sensors. Thereby the monitoring circuit is complex and costly.

What is desired, therefore, is to provide a multi-channel signal monitoring circuit which can monitor a plurality of signals by only employing a single meter chip.

SUMMARY OF THE INVENTION

An exemplary signal monitoring circuit includes a plurality of sensors, a meter chip, a micro control unit (MCU), and a multiplexer. The sensors are adapted for collecting electrical signals of an electrical system, and each of the sensors correspondingly generates an output signal. The multiplexer is adapted for receiving the output signal of each of the sensors. The MCU controls the multiplexer to selectively output one of the output signals. The meter chip receives the selected one of output signals from the multiplexer and generates corresponding meter signals to the MCU.

Other advantages and novel features will become more apparent from the following detailed description when taken in conjunction with the accompanying drawings, in which:

DETAILED DESCRIPTION OF THE INVENTION

Figure 1:
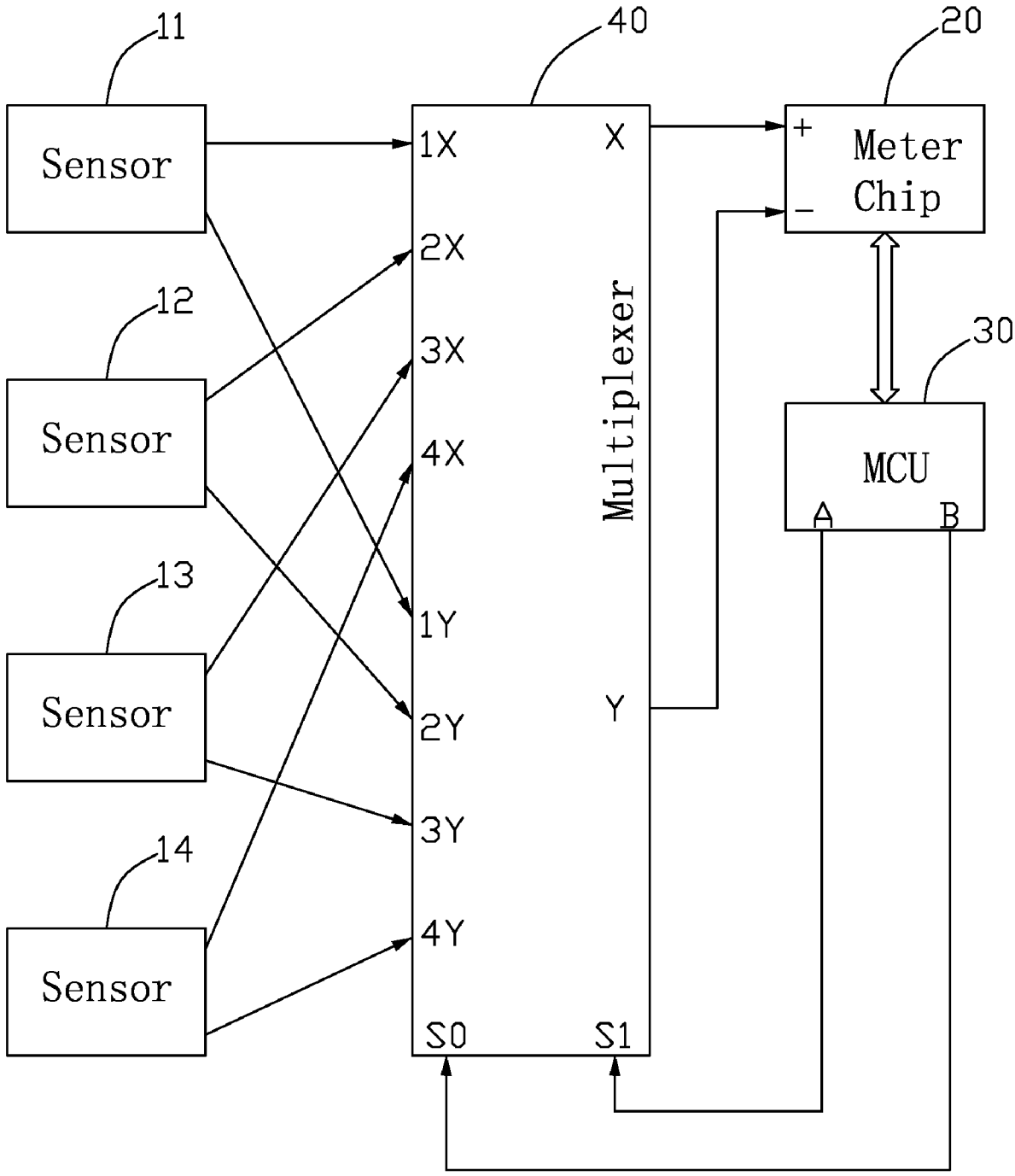
FIG. 1 is a block diagram of a multi-channel signal monitoring circuit of an electrical system in accordance with a preferred embodiment of the present invention.
Figure 2:
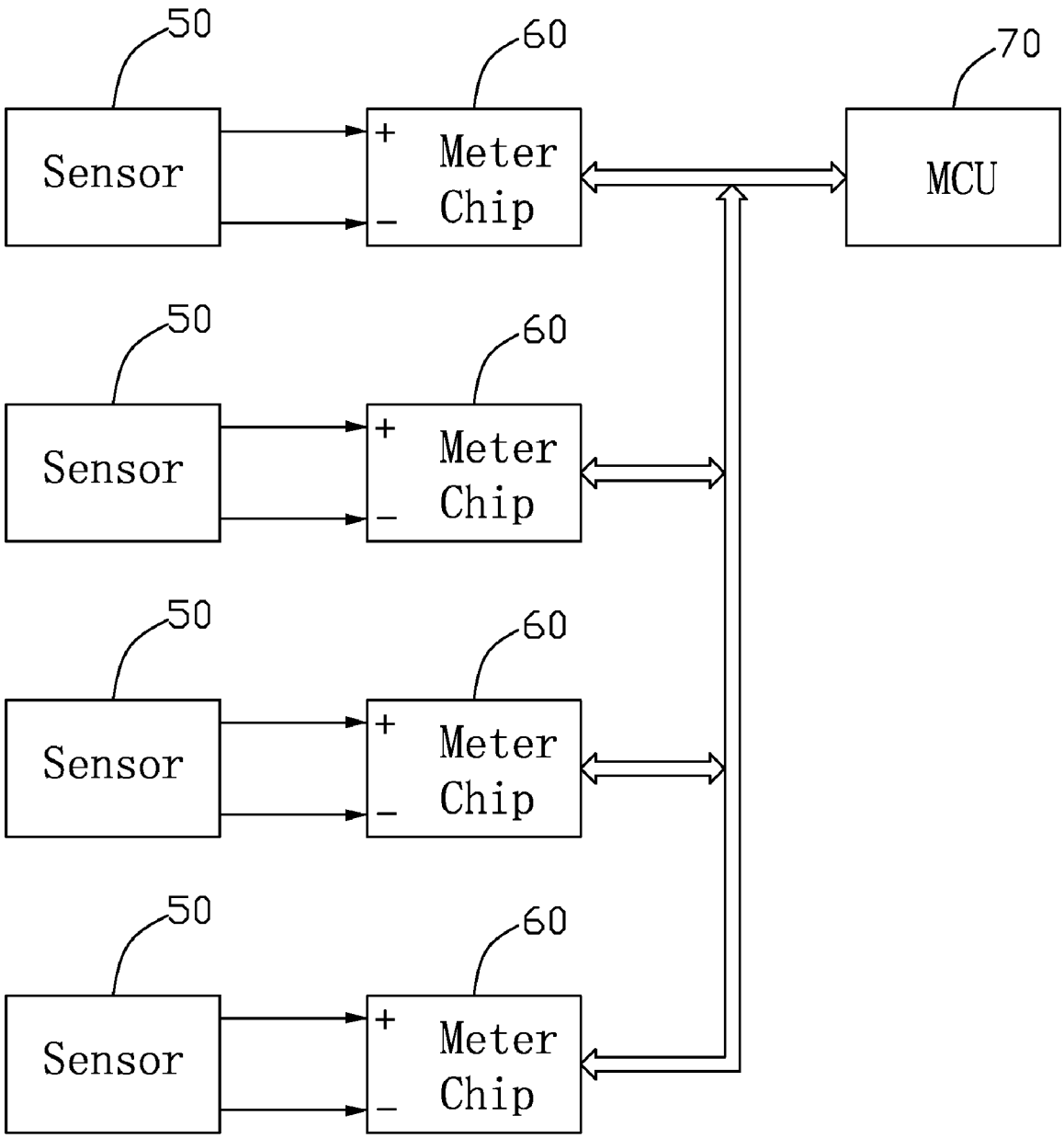
FIG. 2 is a block diagram of a conventional multi-channel signal monitoring circuit of an electrical system.

Referring to FIG. 1, a multi-channel signal monitoring circuit in accordance with a preferred embodiment of the present invention is provided for detecting electrical characteristic signals of an electrical system. The signal monitoring circuit includes four sensors 11-14 such as potential transformers (PT) or current transformers (CT), a meter chip 20, a micro control unit (MCU) 30, and a multiplexer 40. An amount of the sensors can be determined according to need. In this embodiment, the multiplexer 40 is a dual 4-channel analog multiplexer.

The sensors 11-14 are adapted for collecting electrical signals of the electrical system via a plurality of detecting pins (not shown) on a circuit board of the electrical system. Then, the sensor 11 correspondingly outputs a pair of differential signals and transmits them to input terminals 1X, 1Y of the multiplexer 40. The sensor 12 correspondingly outputs a pair of differential signals and transmits them to input terminals 2X, 2Y of the multiplexer 40. The sensor 13 correspondingly outputs a pair of differential signals and transmits them to input terminals 3X, 3Y of the multiplexer 40. The sensor 14 correspondingly outputs a pair of differential signals and transmits them to input terminals 4X, 4Y of the multiplexer 40. Output terminals X, Y of the multiplexer 40 are electrically connected to input terminals +, – of the meter chip 20, respectively. Output terminals of the meter chip 20 are electrically connected to the MCU 30 via a data bus. The meter chip 20 receives the differential signals and generates corresponding meter signals to the MCU 30, and then the MCU 30 processes the meter signals using a preset program.

The multiplexer 40 includes two selecting ports S0, S1 for selecting one of the sensors 11-14 to communicate with the meter chip 20. Two general purpose input/output (GPIO) pins A, B of the MCU 30 are electrically connected to the selecting ports S0, S1 for controlling the multiplexer 40. An amount of the GPIO pins of the MCU 30 can be arranged according to the amount of the sensors. If the amount of the sensors is m, and the amount of the GPIO pins of the MCU 30 is n, the following relationship must be satisfied:

$$2^{n-1} < m \leqq 2^n$$

Wherein, m is greater than 1. In this embodiment, the amount of the chips 20 is four, according to the above formula, two GPIO pins A, B are enough. A truth table of the GPIO pins A, B follows wherein 0 is a low signal and 1 is high and the sensors are selected according to the table:

| | Sensors | | | |
|---|---|---|---|---|
| GPIO pin | 11 | 12 | 13 | 14 |
| A | 0 | 0 | 1 | 1 |
| B | 0 | 1 | 0 | 1 |

A truth table of the input terminals 1X, 1Y; 2X, 2Y; 3X, 3Y; 4X, 4Y of the multiplexer 40 corresponding to the GPIO pins A, B follows:

| | A | B |
|---|---|---|
| 1X/1Y | 0 | 0 |
| 2X/2Y | 0 | 1 |
| 3X/3Y | 1 | 0 |
| 4X/4Y | 1 | 1 |

When the signal monitoring circuit is working, if the MCU 30 needs to detect one of the sensors 11-14 via the meter chip 20, the MCU 30 generates a corresponding control signal to the multiplexer 40 via the GPIO pins A, B, then the multiplexer 40 will select the one of the sensors 11-14 to communicate with the meter chip 20.

Because the signal monitoring circuit uses a multiplexer, the signal monitoring circuit can detect a plurality of sensors via a single meter chip. Thus, the cost of the signal monitoring circuit of the electrical system is less.

It is to be understood, however, that even though numerous characteristics and advantages of the preferred embodiments have been set forth in the foregoing description, together with details of the structures and functions of the embodiments, the disclosure is illustrative only, and changes may be made in detail, especially in matters of shape, size, equivalent material and arrangement of parts within the principles of the invention to the full extent indicated by the broad general meaning of the terms in which the appended claims are expressed.

What is claimed is:

1. A signal monitoring circuit, comprising:

a plurality of sensors adapted for collecting electrical signals of an electrical system, each of the sensors correspondingly generating an output signal;

a meter chip;

a micro control unit (MCU); and a multiplexer receiving the output signal of each of the sensors, the MCU controlling the multiplexer to selectively output one of the output signals, the meter chip receiving said one of the output signals from the multiplexer and generating corresponding meter signals to the MCU.

2. The signal monitoring circuit as claimed in claim 1, wherein the multiplexer is a dual 4-channel analog multiplexer.

3. The signal monitoring circuit as claimed in claim 1, wherein the output signal of each of the sensors is a pair of differential signals.

4. The signal monitoring circuit as claimed in claim 1, wherein each of the sensors is one of a potential transformer (PT) and a current transformer (CT).

5. The signal monitoring circuit as claimed in claim 1, wherein a plurality of general purpose input/output (GPIO) pins of the MCU are respectively electrically connected to selecting ports of the multiplexer to control the multiplexer to selectively output one of the output signals.

6. The signal monitoring circuit as claimed in claim 5, wherein an amount of the sensors and an amount of the GPIO pins of the MCU satisfy:

$$2^{n-1}<m\leqq 2^n$$

wherein m is greater than 1, m is the amount of the sensors, n is the amount of the GPIO pins of the MCU.

7. A signal monitoring circuit comprising:

a plurality of sensors collecting electrical signals of an electrical system and generating signals;

a multiplexer electrically connected to the sensors for receiving the signals generated by the sensors, the multiplexer comprising:

a plurality of selecting ports for receiving a control signal for selecting one of the sensors to output the corresponding signals generated by the selected sensor via the multiplexer; and an output for transmitting the signals generated by the selected sensor;

a meter chip electrically connected to the output of the multiplexer for receiving the signals generated by the selected sensor and outputting corresponding meter signals; and a micro control unit (MCU) receiving the meter signals of the meter chip, and being electrically connected to the selecting ports of the multiplexer for sending the control signal to the multiplexer to select one of the sensors to communicate with the meter chip.

8. The signal monitoring circuit as claimed in claim 7, wherein the multiplexer is a dual 4-channel analog multiplexer.

9. The signal monitoring circuit as claimed in claim 7, wherein the signals generated by each of the sensors are differential signals.

10. The signal monitoring circuit as claimed in claim 7, wherein each of the sensors is one of a potential transformer (PT) and a current transformer (CT).

11. The signal monitoring circuit as claimed in claim 7, wherein a plurality of general purpose input/output (GPIO) pins of the MCU are electrically connected to the selecting ports of the multiplexer to control the multiplexer to select one of the sensors to communicate with the meter chip.

12. The signal monitoring circuit as claimed in claim 11, wherein an amount of the sensors and an amount of the GPIO pins of the MCU satisfy:

$$2^{n-1}<m\leqq 2^n$$

wherein m is greater than 1, m is the amount of the sensors, n is the amount of the GPIO pins of the MCU.

13. A signal monitoring circuit comprising:

a plurality of sensors configured for collecting electrical signals of an electrical system and generating a plurality of pairs of corresponding differential signals;

a meter chip;

a multiplexer comprising a plurality of pairs of inputs respectively electrically connected to the sensors for receiving the differential signals generated by the sensors, a plurality of selecting ports for receiving a control signal for selecting one of the sensors to communicate with the meter chip, and a pair of outputs electrically connected to the meter chip for transmitting the differential signals generated by the selected sensor to the meter chip; and a micro control unit (MCU) electrically connected to the meter chip for receiving meter signals generated by the meter chip in response to the differential signals of the selected sensor, the MCU being electrically connected to the selecting ports of the multiplexer for sending the control signal to the multiplexer.

14. The signal monitoring circuit as claimed in claim 13, wherein the multiplexer is a dual 4-channel analog multiplexer and comprises a pair of selecting ports, and the MCU comprises a pair of general purpose input/output (GPIO) pins respectively electrically connected to the selecting ports of the multiplexer.

* * * * *